United States Patent [19]

Gehlbach

[11] 4,316,525

[45] Feb. 23, 1982

[54] LADDER FOR PLAY STRUCTURE

[75] Inventor: Roger D. Gehlbach, White Rock, Canada

[73] Assignee: Gehlbach Engineering Ltd., White Rock, Canada

[21] Appl. No.: 146,812

[22] Filed: May 5, 1980

[51] Int. Cl.[3] ..... E06C 5/36; A63B 9/00

[52] U.S. Cl. ..... 182/106; 272/113; 182/93

[58] Field of Search ..... 182/106, 93, 99; 272/109, 110, 112, 113, 62, 56.5 R

[56] References Cited

U.S. PATENT DOCUMENTS 2,368,081 1/1945 Marsh ..... 182/106

3,891,207 6/1975 Helliwell ..... 272/62

*Primary Examiner*—Reinaldo P. Machado

*Attorney, Agent, or Firm*—Townsend and Townsend

[57] ABSTRACT

A ladder for a children's play structure comprises spaced-apart, elongate side members extending from a first end of the ladder to a second end thereof. A plurality of rungs extend perpendicularly between the side members, adjacent rungs having a distance therebetween which increases from the first end of the ladder to the second end. A third elongate member, parallel to the side members and midway therebetween, extends substantially from the first end of the ladder to the second end. The third member is outwardly spaced, away from the rungs, such that a child climbing the ladder from the first end towards the second end, having his feet on the rungs and grasping the third member, exercises his arm and torso muscles in lifting his body.

6 Claims, 4 Drawing Figures

LADDER FOR PLAY STRUCTURE

BACKGROUND OF THE INVENTION

This invention relates to a ladder for a children's play structure.

In earlier patents, German Pat. No. 713,545 discloses a ladder having a central support beginning above the bottom three rungs and extending upwardly beyond the ladder. Similar ladders are shown in U.S. Pat. No. 2,368,081 to Marsh and in British Pat. No. 701,407. British Pat. No. 12,635 shows a ladder with guard members A.

The prior art does not reveal a ladder adapted for use with a child's play structure which accommodates children of various ages and which promotes the exercising of specific muscle groups in the user's body.

SUMMARY OF THE INVENTION

According to the invention, a ladder for a children's play structure comprises spaced-apart, elongate side members extending from a first end of the ladder to a second end thereof. A plurality of rungs extend perpendicularly between the side members, adjacent rungs having a distance therebetween which increases from the first end of the ladder to the second end. A third elongate member, parallel to the side members and midway therebetween, extends substantially from the first end of the ladder to the second end. The third member is outwardly spaced-apart from the rungs, whereby a child climbing the ladder from the first end towards the second end, having his feet on the rungs and grasping the third member, exercises his arm, leg, and torsol muscles in lifting his body.

The invention provides the advantages of a climbing ladder for children which promotes the exercising and development of arm and torso muscles as well as leg muscles. The ladder is adapted to children of different sizes and ages and allows a child to climb higher as he develops.

DESCRIPTION OF THE PREFERRED EMBODIMENTS

Figure 1:
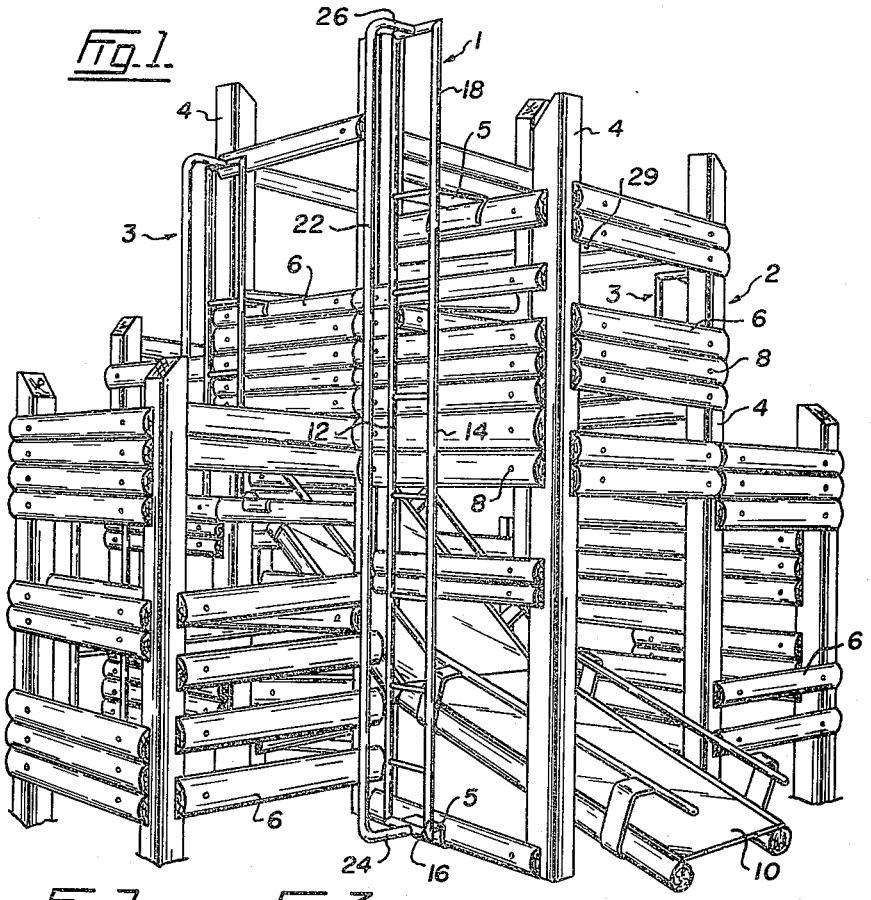
FIG. 1 is a perspective view of a ladder and a children's play structure according to the invention.
Figure 2:
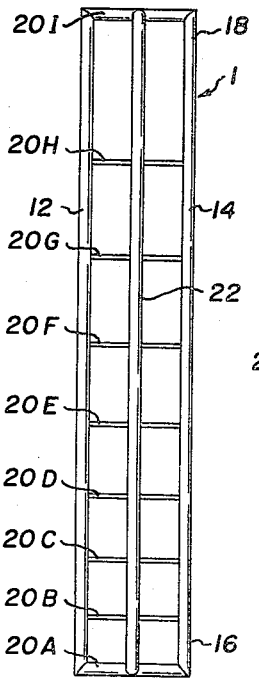
FIG. 2 is a front elevational view of a ladder according to an embodiment of the invention.
Figure 3:
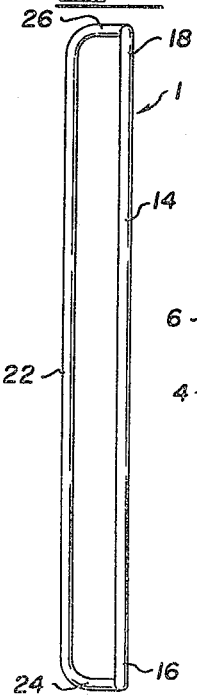
FIG. 3 is a side elevational view of the ladder of FIG. 2.

Referring to FIG. 1, the ladder 1 is connected by brackets 5 to the child's play structure 2, which may also be regarded as a physical education apparatus, in a vertical position. A second similar ladder 3 is also shown. If desired, ladders of different heights and dimensions may be fitted. The play structure 2 comprises a plurality of upright squared timbers 4 and a plurality of horizontal logs 6 extending therebetween. The logs are connected to the upright timbers by lag bolts 8 which extend diagonally through the logs and into the upright timbers towards the centres thereof. The upright members 4 are fitted within right angled notches at the ends of each of the logs 6. Other accessories can be added to the play structure such as the slide 10.

The ladder 1 has a pair of spaced-apart, elongate side members 12 and 14 which extend from the first or bottom end 16 to the top or second end 18.

The ladder also has a plurality of rungs 20A to 20I which extend perpendicularly between side members 12 and 14. As may be seen, the distance between the rungs increases from the bottom of the ladder towards the top. For example, the distance between the second rung 20B and the third rung 20C is greater than the distance between rung 20A at the bottom and the second rung 20B. The distance between rung 20C and 20D, nearer the top, is even greater. The distance between the rungs increases upwardly to rungs 20G and 20H. In a typical ladder, the distance increased from 12" at the bottom to 18" at the top. Rungs 20H and 20I are positioned so that a child standing on the former has a convenient handhold on the ladder and allows access to platform 29 between these rungs.

Ladder 1 also includes an elongate support member 22 extending parallel to the side membes 12 and 14 and midway therebetween. Support member 22 extends substantially from the bottom end of the ladder to the top end and has a perpendicular portion 24 at the bottom end connected to rung 20A. A similar perpendicular portion 26 at the top end is connected to rung 21I. In the preferred embodiment, the support member 22 along with side members 12 and 14 and rungs 20 are made of steel pipe and welded connections are used throughout. As seen, the support member 22 is outwardly spaced apart from the rungs 20.

Figure 4:
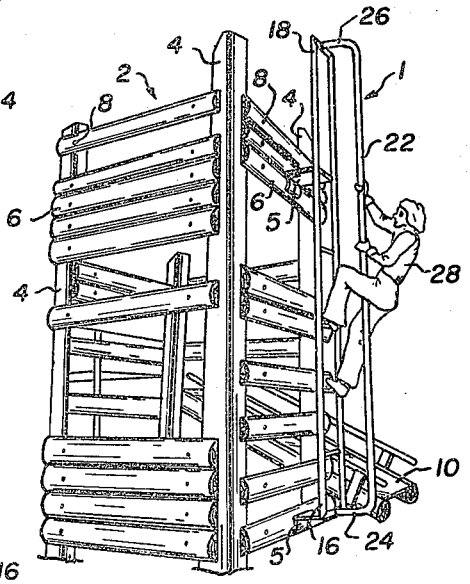
FIG. 4 is a perspective view of a ladder and play structure according to the invention, showing a child climbing the ladder in a manner to exercise arm, leg and torso muscles.

In use, as illustrated in FIG. 4, ladder 1 is climbed by a child 28 having his feet on two adjacent rungs and his two hands grasping the support member 22. The arm and torso muscles of the child can therefore provide a significant amount of the force required to lift his body. This feature is particularly useful for smaller children who haven't fully developed their muscles or for children with disabilities in one or more limbs. The support member 22 also gives a degree of confidence to children who are learning to climb a ladder or who may have some fear of heights.

There is an important interaction between the provision of support member 22 and the increase in distance between the rungs from the bottom of the ladder towards the top. Because of the increase in distance between the rungs, a child climbing the ladder from rung to rung, with his body separated horizontally from the ladder, itself, must exert the muscles of his upper body in order to supplement those of his lower body to lift himself. Additionally, the smaller distance between the bottom rungs allows even a small child to climb some distance. However, as the child grows and develops he can climb higher on the ladder and his development is thereby promoted. There are no rungs in the top 30 inches of the ladder, allowing young users access to the upper platform 29 without exposing themselves to danger in the course of climbing around the outside of the ladder.

To summarize the advantages of the invention:

1. The increased distance between the rungs can be set so that children of very young age will be prevented from ascending completely, but will be able to use it to safe heights.

2. For children competent to ascend to the full height of the ladder, the increased distance between rungs ensures a progressively higher exercise of the upper-body muscle groups, as the strength required of lower-body muscle groups increases.

3. The third member separates the user's body from the vertical ladder in a horizontal direction thereby increasing the use of upper body muscle groups to pull the user upwards.

4. Small children may use the third member as a "fireman's pole" without having necessarily to begin from the very top.

What is claimed is:

1. A ladder for a children's play structure, comprising:

a pair of spaced-apart, elongate side members extending from a first end of the ladder to a second end thereof;

a plurality of rungs extending perpendicularly between the side members, adjacent rungs having a distance therebetween, said distance increasing successively between adjacent rungs from the first end of the ladder towards the second end; and a third elongate member, parallel to the side members and midway therebetween, extending substantially from the first end of the ladder to the second end, the third member being outwardly spaced-apart a substantial distance from the rungs, whereby a child climbing the ladder from the first end towards the second end, having his feet on the rungs and grasping the third member, exercises arm, torso and leg muscles in lifting his body.

2. A ladder as claimed in claim 1 comprising rungs at the first and second ends of the ladder, the third member having portions at each end extending perpendicularly towards the rung at said each end and being connected thereto.

3. A ladder as claimed in claim 2, the side members, rungs and third member comprising metal pipes.

4. A combination of a ladder as claimed in claim 1 and a child's play structure or physical education apparatus.

5. A combination as claimed in claim 4, the ladder being generally vertical, the second end being above the first end.

6. A ladder as claimed in claim 1, the first end being the lower end and the second end being the upper end.

* * * * *